US011437202B2

(12) United States Patent
Strebel Marzano et al.

(10) Patent No.: US 11,437,202 B2
(45) Date of Patent: Sep. 6, 2022

(54) SWITCHING DEVICE WITH LOCK OPEN COMPONENT

(71) Applicant: ROCKWELL AUTOMATION SWITZERLAND GMBH, Aarau (CH)

(72) Inventors: Thomas Strebel Marzano, Aarau (CH); David Urech, Aarau (CH)

(73) Assignee: ROCKWELL AUTOMATION SWITZERLAND GMBH, Aarau (CH)

( * ) Notice: Subject to any disclaimer, the term of this patent is extended or adjusted under 35 U.S.C. 154(b) by 193 days.

(21) Appl. No.: 16/914,947

(22) Filed: Jun. 29, 2020

(65) Prior Publication Data

US 2021/0407745 A1 Dec. 30, 2021

(51) Int. Cl.
*H01H 5/04* (2006.01)

(52) U.S. Cl.
CPC ..... *H01H 5/04* (2013.01)

(58) Field of Classification Search
CPC .. H01H 5/04; H01H 71/504; H01H 2300/048; H01H 2300/05
See application file for complete search history.

(56) References Cited

U.S. PATENT DOCUMENTS

| | | | | |
|---|---|---|---|---|
| 3,299,244 A * | 1/1967 | Strobel | ..... | H01H 9/24 200/318 |
| 3,562,469 A | 2/1971 | Peck | | |
| 5,793,270 A * | 8/1998 | Beck | ..... | H01H 77/104 335/46 |
| 5,931,289 A | 8/1999 | Chou | | |

FOREIGN PATENT DOCUMENTS

| | | |
|---|---|---|
| DE | 3508110 C2 | 8/1989 |
| DE | 4442417 C1 | 2/1996 |
| DE | 19703977 C1 | 5/1998 |
| EP | 2768006 B1 | 4/2017 |
| EP | 3293750 B1 | 12/2019 |
| EP | 3293751 B1 | 12/2019 |

OTHER PUBLICATIONS

European Patent Office, "Communication pursuant to Rule 62 EPC, Extended Search Report", application No. 21180830.8 EPO, dated Dec. 3, 2021, 13 pages.

* cited by examiner

*Primary Examiner* — Vanessa Girardi

(57) ABSTRACT

A switch device includes a lock component and a crossbar. The crossbar is configured to open or close electric contacts. The crossbar includes a lock receiving section for receiving the lock component after the switch device is turned to an ON position for a period of time. The lock component is disengaged from the lock receiving section after the period of time to allow the crossbar jump upwards to close the electric contacts quickly.

18 Claims, 7 Drawing Sheets

SWITCHING DEVICE WITH LOCK OPEN COMPONENT

TECHNICAL FIELD

This application relates generally to switch devices, and more particularly to mechanical switch devices with jump-on mechanism.

BACKGROUND

Switching devices are generally used throughout industrial, commercial, material handling, process, and manufacturing settings, to mention only a few. As used herein, "switching device" is generally intended to describe any electromechanical switching device, such as mechanical switching devices (e.g., a circuit breaker, a contactor, a relay, air break devices, and controlled atmosphere devices). More specifically, switching devices generally open to disconnect electric power from a load and close to connect electric power to the load. As the switching devices open or close, electric power may be discharged as an electric arc and/or cause erosion of silver tip contacts in the switching devices. To facilitate reducing likelihood and/or magnitude of the contact erosion, the switching devices may be designed to close the contacts very fast (e.g., in single digit milliseconds) in order to shorten the burning time of the arc flash. As such, the present disclosure relates to various different technical improvements in the field of sudden mechanical switch, which may be used in various combinations to provide advances in the art.

SUMMARY

The following presents a simplified summary of the claimed subject matter in order to provide a basic understanding of some aspects described herein. This summary is not an extensive overview, and is not intended to identify key/critical elements or to delineate the scope of the claimed subject matter. Its sole purpose is to present some concepts in a simplified form as a prelude to the more detailed description that is presented later.

One embodiment is a switch device that includes a lock component and a crossbar. The crossbar is configured to open or close electric contacts. The crossbar includes a lock receiving section for receiving the lock component when the switch device is turned to an OFF position and after the switch device is turned to an ON position for an initial period of time. The lock component is disengaged from the lock receiving section after the period of time to allow the crossbar jump upwards to close the electric contacts quickly.

Another embodiment is a circuit breaker that includes a switching system configured to provide jump-on switching. The switch device includes a lock component and a crossbar. The crossbar is configured to open or close electric contacts. The crossbar includes a lock receiving section for receiving the lock component when the switch device is turned to an OFF position and after the switch device is turned to an ON position for an initial period of time. The lock component is disengaged from the lock receiving section after the period of time to allow the crossbar jump upwards to close the electric contacts quickly.

Another embodiment is a switch device including a lock component and a crossbar. The lock component includes a spring portion and a lever portion. The crossbar is configured to open or close electric contacts. The crossbar includes a lock receiving section for engaging with the lever portion when the device is turned to an OFF position and after the switch device is turned to an ON position for an initial period of time. When the lever portion is engaged with the receiving section, the crossbar open the electric contacts.

The following description and annexed drawings set forth certain illustrative aspects of the specification. These aspects are indicative, however, of but a few of the various ways in which the principles of the specification can be employed. Other advantages and novel features of the specification will become apparent from the following detailed description of the specification when considered in conjunction with the drawings.

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. It should be noted that certain passages of this disclosure can reference terms such as "first" and "second" in connection with ends, materials, etc., for purposes of identifying or differentiating one from another or from others. These terms are not intended to merely relate entities (e.g., a first end and a second end) temporally or according to a sequence, although in some cases, these entities can include such a relationship. Nor do these terms limit the number of possible entities (e.g., materials) that can operate within a system or environment.

Figure 1A:
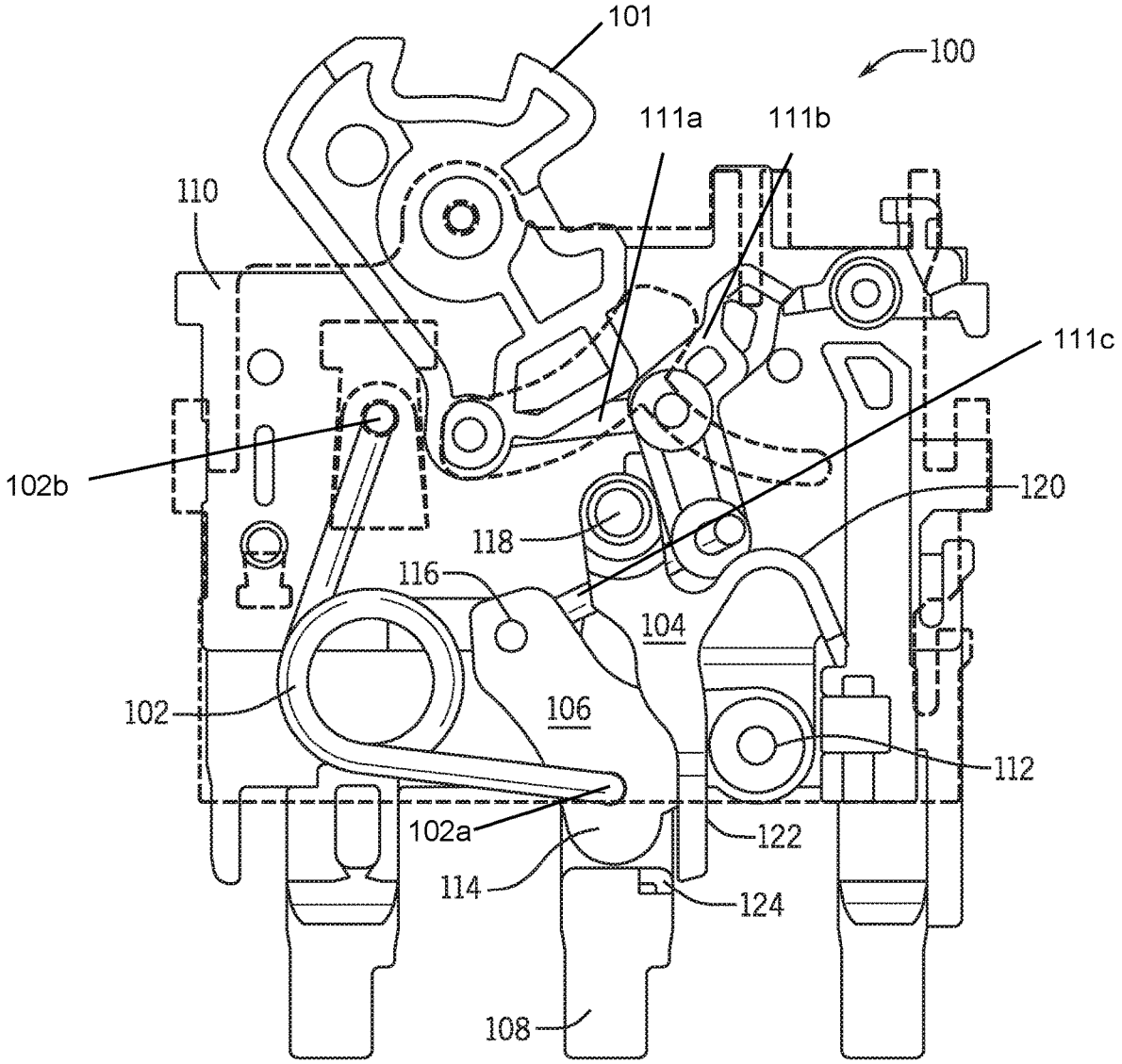
FIGS. 1A and 1B are perspective views of a switching device on an OFF position according to an illustrative embodiment.
Figure 1B:
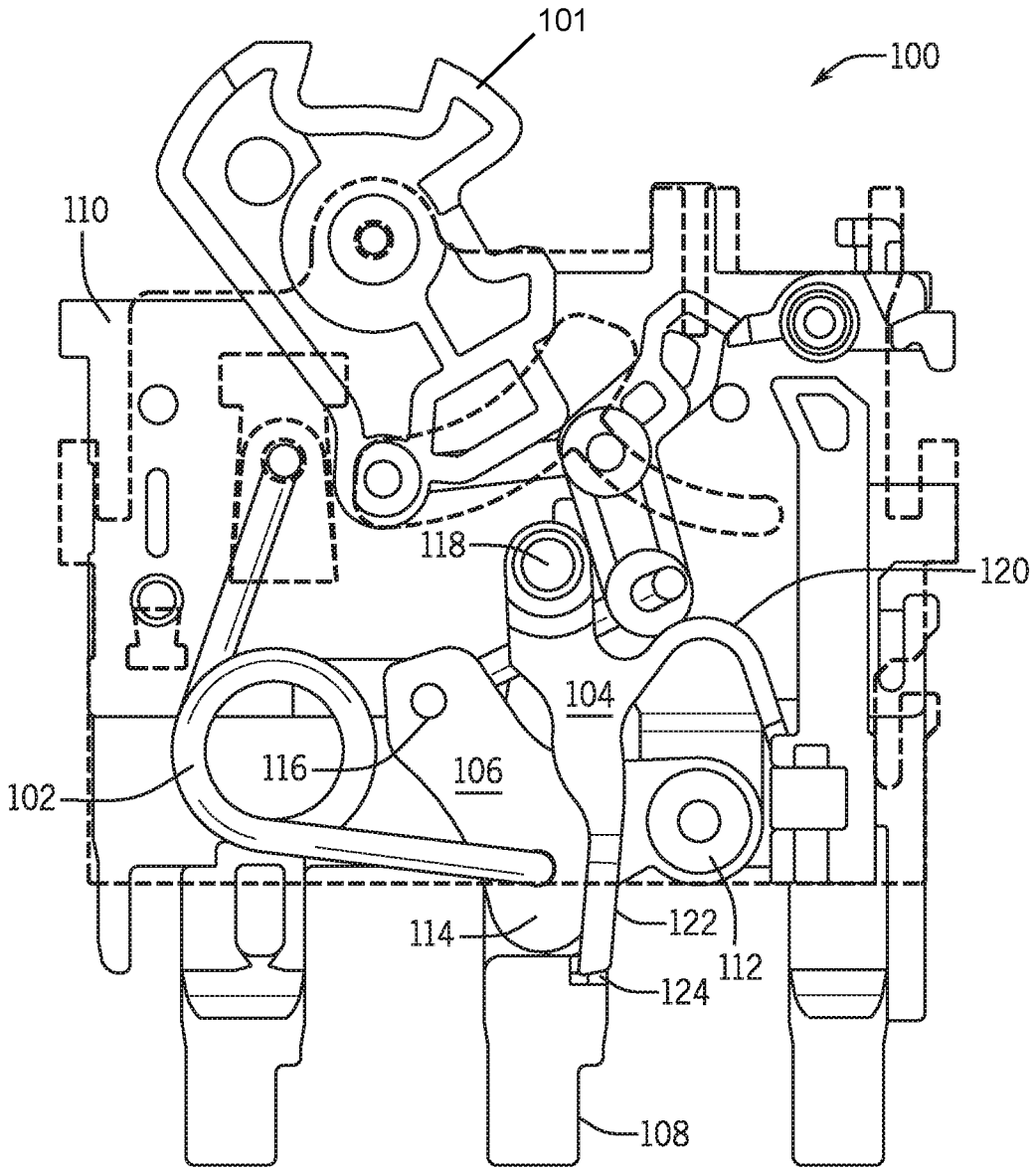

FIGS. 1A and 1B are perspective views of a switching device 100 on an OFF position according to an illustrative embodiment. The switching device 100 is a mechanical switching device that includes an operating element 101 that is controlled by an operator. The operator can switch on or off the switching device 100 to enable or disable engaging the electric contacts by operating the operating element 101. For example, an operating element may be a push button switch element or a rotary switch element 101. The switching device 100 can be part of a switching system within a circuit breaker. The switching device 100 is configured with a jump-on mechanism that allows the switching device 100 switching on (i.e., making electric contacts to close current path) at a desired short period of time when the operator switches on the operating element. The desired short period of time for making electric contacts is independent of the operations of the operator. In this way, closing the electric current path is not affected by the operator's operation.

The switching device 100 incudes a latching system that is connected to the operating element to operate on a crossbar 108. The latching system includes a spring 102, a lever 106, a lock component 104, a latching plate 110, and one or more connecting components 111*a*, 111*b*, 111*c* (shown in FIG. 1A).

The crossbar 108 is configured to move one or more electric contacts to open or close the current path. For example, a bottom end of the crossbar 108 may be operatively connected to one or more movable contacts. When the crossbar 108 is moving downward, the crossbar 108 is pushing the movable contacts away from one or more fixed contacts to open the current path. When the crossbar 108 is moving upwards, the crossbar 108 releases force on the movable contacts so that the movable contactors can be pushed upwards by a spring mechanism to close the current path. The crossbar 108 is operatively connected to the lever 106 at the top end of the crossbar 108.

The lever 106 is controlled by the operating element 101 through operative connections to the operating element 101 via the one or more connecting components 111*a*, 111*b*, 111*c*. A first end 112 of the lever 106 is connected to the latching plate 110. The latching plate 110 is in a fixed position that may be mounted to a housing of the switching device 100. The first end 112 of the lever 106 is rotatable about a fixed connecting point of the latching plate 110. A second end 116 of the lever 106 is connected to the connecting component 111*c* to receive movement from the operating element 101. A middle portion 114 of the lever 106 is connected to a first end 102*a* of the spring 102. A second end 102*b* of the spring 102 is connected to the latching plate 110.

The lock component 104 includes a spring portion 120, a fixed portion 118, and a lever portion 122. In some embodiments, the spring portion 120, the fixed portion 118, and the lever portion 122 may be formed as a single piece with same material. In some embodiments, the spring portion 120, the fixed portion 118, and the lever portion 122 may be formed with different materials. The fixed portion 118 is connected to the latching plate 110. The lock component 104 is designed to connect to the latching plate 110 and is rotatable about the fixed portion 118. The spring portion 120 is connected to the latching plate 110. In some embodiments, the spring portion 120 is connected to the first end 112 of the lever 106. The lever portion 122 is disposed adjacent to the crossbar 108 such that the lever portion 122 contacts a side wall of the crossbar 108 and can slide along the side wall when the crossbar 108 moves up and down.

When the operating element 101 is switched to an OFF position, an OFF switching sequence starts. The OFF sequence includes that the spring 102 pushes the lever 106 moving counterclockwise about the first end portion 112. When the lever 106 moves counterclockwise, the middle portion 114 of the lever 106 pushes the crossbar 108 downwards and the side wall of the crossbar 108 keeps in contact with the lever portion 122 of the lock component 104 while moving downwards because of the restore force from the compressed spring portion 120 pushing the lever portion 122 to the side wall of the crossbar 108. When the middle portion 114 of the lever 106 reaches the lowest position in the OFF switching sequence as shown in FIG. 1A, the lever portion 122 is pushed to move clockwise by the restore force of the spring portion 120. The restore force of the spring portion 120 pushes the lever portion 122 to click in a lock receiving section 124 located on a top corner of the crossbar 108 as shown in FIG. 1B. The lock component 104 is designed with a length that enables the lever portion clicking in the lock section 124 when the middle portion 114 of the lever 106 reaches the lowest position. When the lever portion 122 is clicked in the lock receiving section 124, the crossbar 108 is locked and stopped from moving upwards. When the crossbar 108 is locked, the switching device 100 stays on the OFF position (i.e., the contact are open to disable the current path). The lock receiving section 124 is configured as a recessed corner or platform at a top corner of the crossbar 108 that can receive the lever portion 122 of the lock component 104.

Figure 2A:
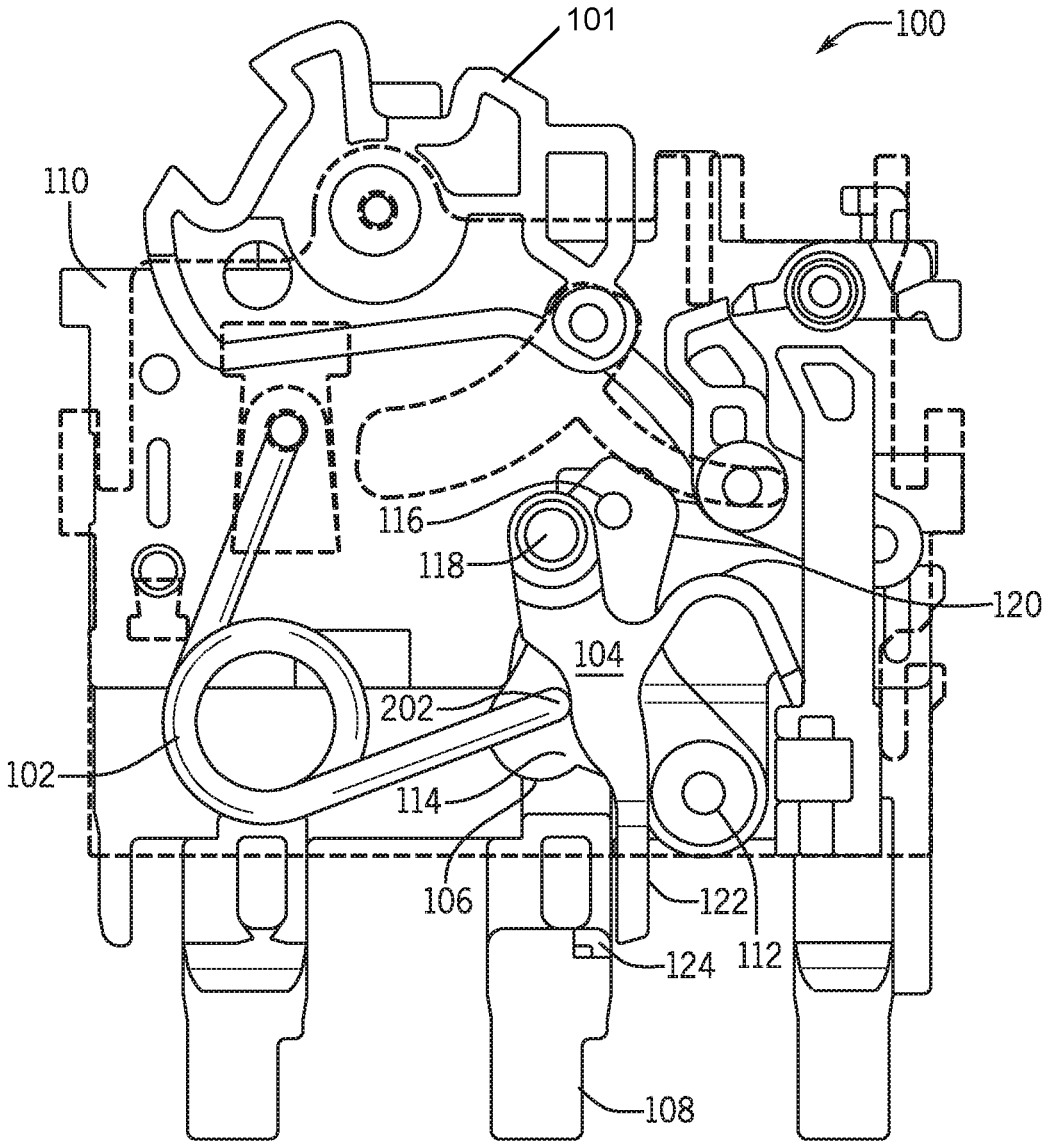
FIG. 2A and FIG. 2B are perspective views of the switching device of FIG. 1A and FIG. 1B on an ON position according to an illustrative embodiment.
Figure 2B:
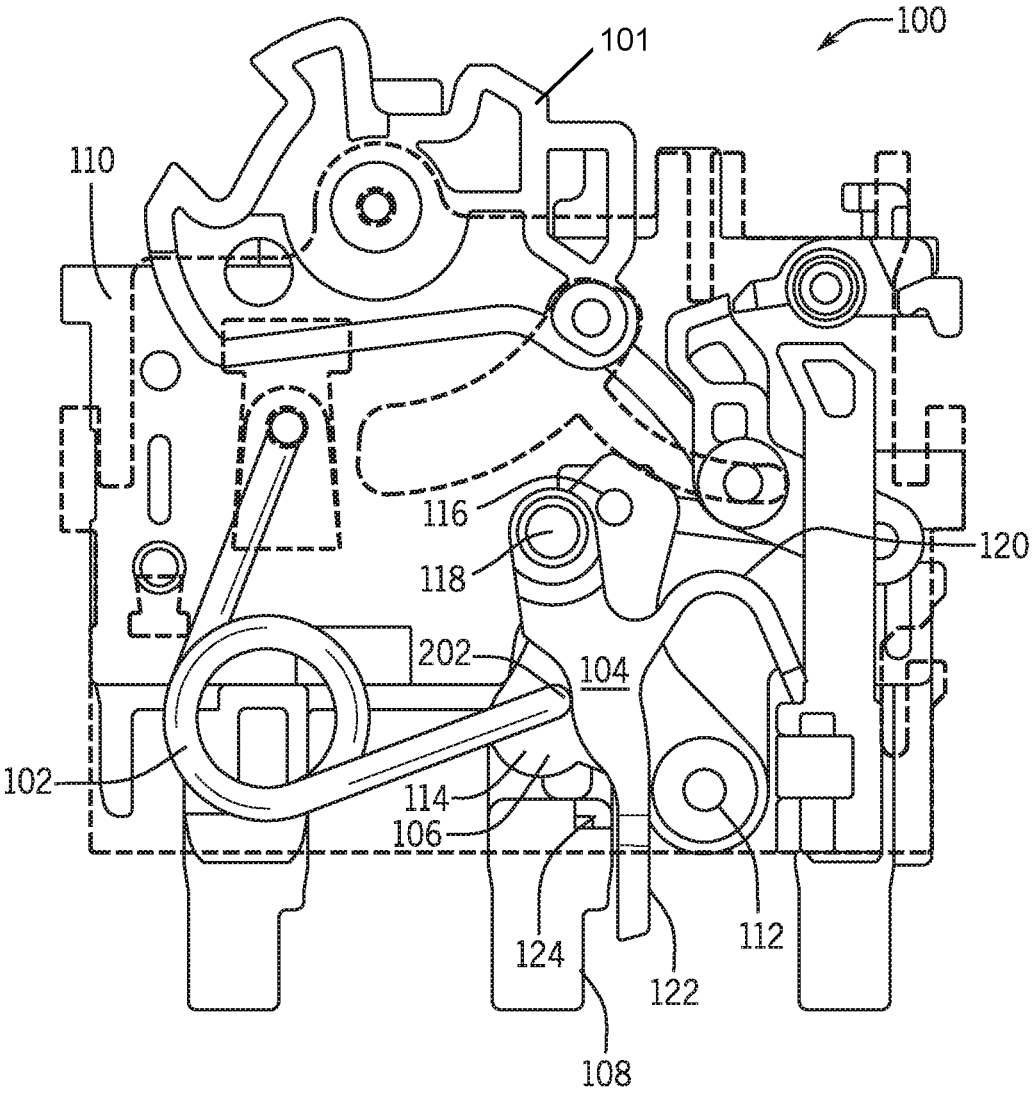

FIG. 2A and FIG. 2B are perspective views of the switching device 100 on an ON position according to an illustrative embodiment. When the operating element 101 is switched to an ON position, an ON switching sequence starts. The ON switching sequence includes that the lever 106 is moved clockwise about the first end portion 112. While the lever 106 is moving clockwise, the crossbar 108 starts in the lock position shown in FIG. 1B, i.e., in the position in which the crossbar 108 is prevented from moving upwards because of the lock component 104 being engaged in the lock receiving section 124. When the lever 106 keeps moving to a position where the spring 102 that is connected to the middle portion 114 contacts an unlock point 202 at the lock component 104, the spring 102 pushes the lock component 104 to move in a counterclockwise direction. When the lock component 104 is pushed by the spring 102 counterclockwise at the unlock point 202, the lever portion 122 is pushed out of the lock receiving section 124 as shown in FIG. 2A. The crossbar 108 is no longer in the lock position and released to jump upwards by the restore force of the contact springs (not shown). When the crossbar 108 jumps upwards, the crossbar 108 stops moving upwards when the contacts are closed. At this point the switching device enables the current path. The crossbar 108 always travels same distance upwards when the lock component 104 is released from the lock position. In this way, it takes the same time for the contact to close at each switching on operation independent of variations of the operators' operations. The unlock point 202 of the lock component 104 is designed with a convex surface towards the spring 102. For example, the lock component 104 may have a bump on the surface that contacts the spring 102. When the lock component 104 is pushed out of the locking position, the spring portion 120 is compressed and the lever portion 122 contacts the side wall of the crossbar 108. The lever portion 122 is configured to be engaged with the lock receiving section 124 for a period of time. The period of time is determined according to the distance between the end surface of the lever portion 122 and the unlock point 202.

Figure 3A:
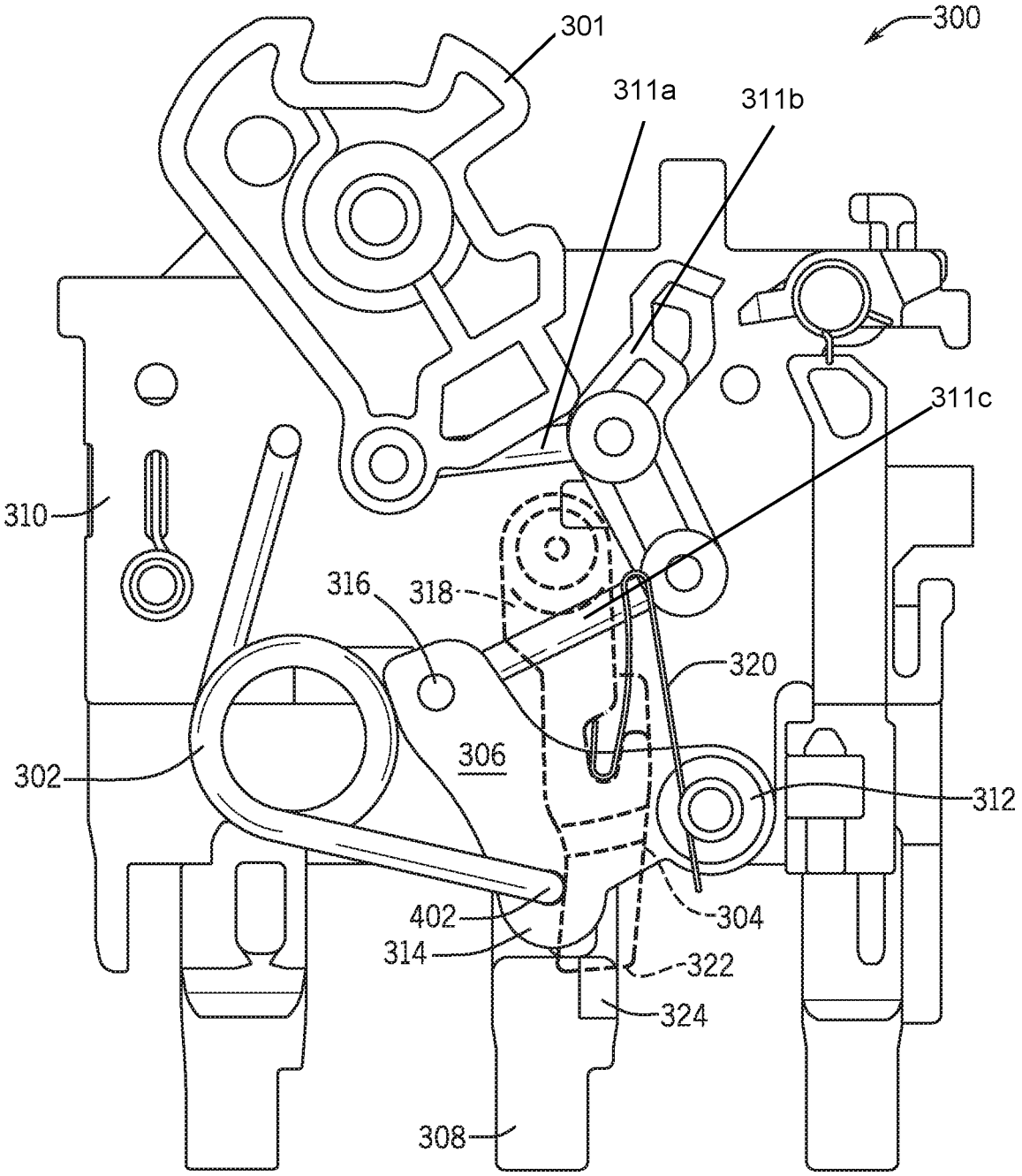
FIG. 3A is a perspective view of a switching device on an OFF position according to an illustrative embodiment.

FIG. 3A is a perspective view of a switching device 300 on an OFF position according to an illustrative embodiment. The switching device 300 is a mechanical switching device that includes an operating element 301 that is controlled by an operator. The operator can switch on or off the switching device 300 to enable or disable engaging the electric contacts by operating the operating element. For example, an operating element may be a push button switch element or a rotary switch element 301. The switching device 300 can be a switching system within any circuit breakers. The switching device 300 is configured with a jump-on mechanism that allows the switching device 300 switching on (i.e., making electric contacts to close current path) at a desired short period of time when the operator switches on the operating element. The desired short period of time for making electric contacts is independent of the operations of the operator. In this way, closing the electric current path is not affected by the operator's operation.

The switching device 300 incudes a latching system that is connected to the operating element to operate on a crossbar 308. The latching system includes a spring 302, a lever 306, a lock component 304, a latching plate 310, and one or more connecting components 311*a*, 311*b*, 311*c*.

The crossbar 308 is configured to move one or more electric contacts to open or close the current path. For example, a bottom end of the crossbar 308 may be operatively connected to one or more movable contacts. When the crossbar 308 is moving downward, the crossbar 308 is pushing the movable contacts away from one or more fixed contacts to open the current path. When the crossbar 308 is moving upwards, the crossbar 308 releases force on the movable contacts so that the movable contactors can be pushed upwards by a spring mechanism to close the current path. The crossbar 308 is operatively connected to the lever 306 at the top end of the crossbar 308.

The lever 306 is controlled by the operating element 301 through operative connections to the operating element 301 via the one or more connecting components 311*a*, 311*b*, 311*c*. A first end 312 of the lever 306 is connected to the latching plate 310. The latching plate 310 is in a fixed position that may be mounted to a housing of the switching device 300. The first end 312 of the lever 306 is rotatable about a fixed connecting point of the latching plate 310. A second end 316 of the lever 306 is connected to the one or more latching components to receive movement from the operating element. A middle portion 314 of the lever 306 is connected to a first end of the spring 302. A second end of the spring 302 is connected to the latching plate 310.

The lock component 304 includes a spring portion 320, a fixed portion 318, and a lever portion 322. The spring portion 320 is formed as a single piece made of a first material (e.g., metal). The fixed portion 318 and the lever portion 322 are formed as a single piece with a second material (e.g., plastic). The spring portion 320 is joined to the fixed portion 318 and the lever portion 322 using any suitable joining mechanism. The fixed portion 318 is connected to the latching plate 310. The lock component 304 is designed to connect to the latching plate 310 and is rotatable about the fixed portion 318. In some embodiments, the spring portion 320 is connected to the first end 312 of the lever 306. The lever portion 322 is disposed adjacent to the crossbar 308 such that the lever portion 322 contacts a side wall of the crossbar 308 and can slide along the side wall when the crossbar 308 moves up and down.

Figure 3B:
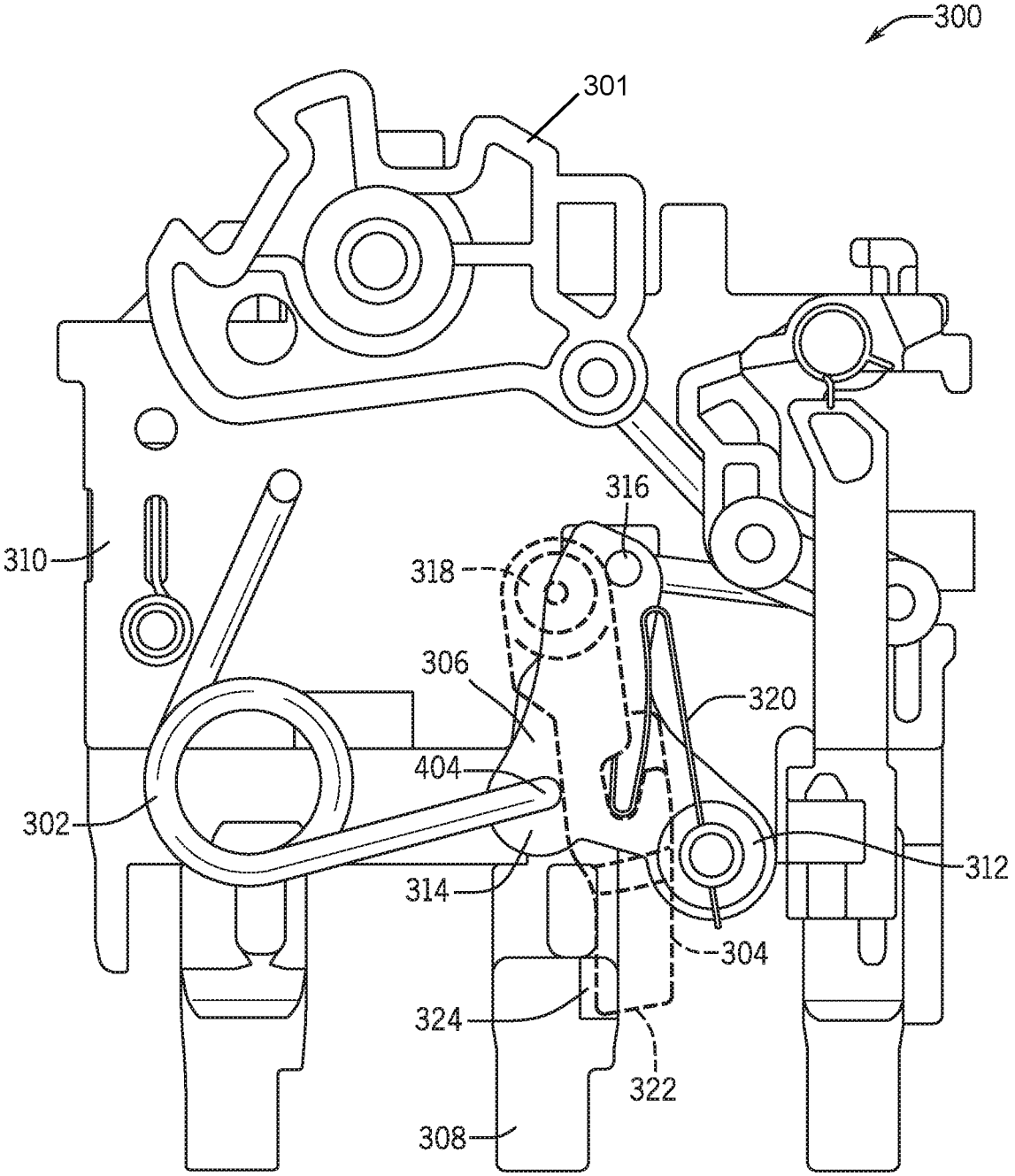
FIG. 3B is a perspective view of the switch device of FIG. 3A before the jump position according to an illustrative embodiments.

When the operating element 301 is switched to an OFF position, an OFF switching sequence starts. The OFF sequence includes that the spring 302 pushes the lever 306 moving counterclockwise about the first end portion 312. When the lever 306 moves counterclockwise, the middle portion 314 of the lever 306 pushes the crossbar 308 downwards and the side wall of the crossbar 308 keeps in contact with the lever portion 322 of the lock component 304 while moving downwards because of the restore force from the compressed spring portion 320 pushing the lever portion 322 to the side wall of the crossbar 308. When the connection portion 314 of the lever 306 reaches a lock point 402 of the lock component 304 as shown in FIG. 3A, the lever portion 322 is pushed to move counterclockwise by the spring 302 and the lever 306 to click in a lock receiving section 324 located on a top corner of the crossbar 308 as shown in FIG. 3B. The lock receiving section 324 is configured as a recessed corner or platform of the crossbar 308 that can receive the lever portion 322 of the lock component 304. The lock component 304 is designed with a length that enables the lever portion clicking in the lock section 324 when the middle portion 314 of the lever 306 reaches the lock point 402. When the lever portion 322 is clicked in the lock receiving section 324, the crossbar 308 is locked and stopped from moving upwards. When the crossbar 308 is locked, the switching device 300 stays on the OFF position (i.e., the contact are open to disable the current path).

Figure 3C:
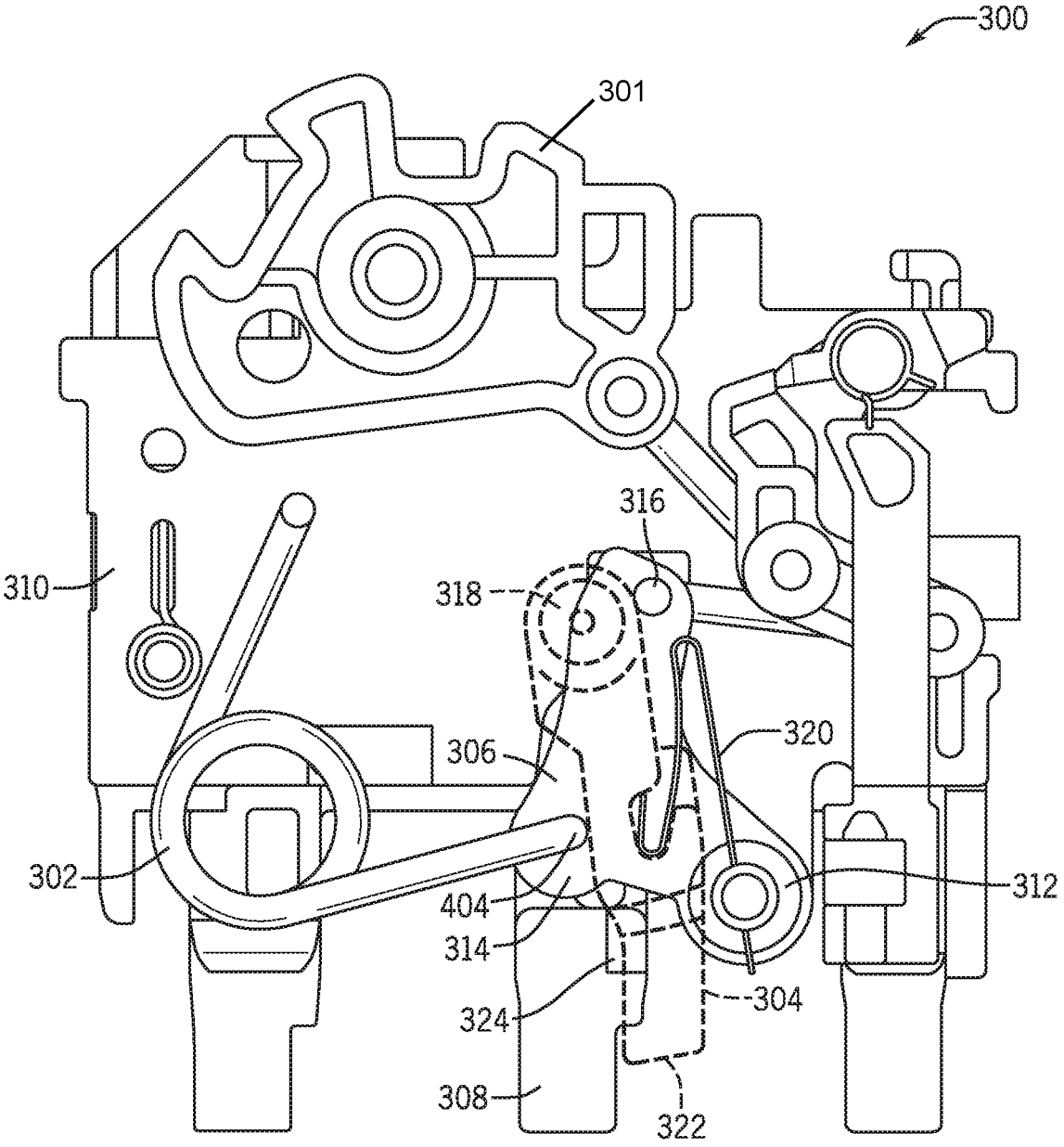
FIG. 3C is a perspective view of the switching device of FIG. 3A and FIG. 3B after jump at an on position according to an illustrative embodiment.

FIG. 3B is a perspective view of the switch device 300 before the jump position according to an illustrative embodiments. FIG. 3C is a perspective view of the switching device 300 after jump at an on position according to an illustrative embodiment. When the operating element 301 is switched to an ON position, an ON switching sequence starts. The ON switching sequence includes that the lever 306 is moved clockwise about the first end portion 312. While the lever 306 is moving clockwise, the crossbar 308 is moved out of the lock position shown in FIG. 3B, i.e., the position in which the crossbar 308 is prevented from moving upwards because of the lock component 304 being engaged in the lock receiving section 324. When the lever 306 keeps moving to a position where the spring 302 that is connected to the middle portion 314 contacts an unlock point 404 at the lock component 304, the spring 302 pushes the lock component 304 to move in a counterclockwise direction. When the lock component 304 is pushed by the spring 302 counterclockwise at the unlock point 404, the lever portion 322 is pushed out of the lock receiving section 324 as shown in FIG. 3C. The crossbar 308 is no longer in the lock position and released to jump upwards by the restore force of the contact springs (not shown). When the crossbar 308 jumps upwards, the crossbar 308 stops moving upwards when the contacts are closed. At this point the switching device enables the current path. The crossbar 308 always travels same distance upwards when the lock component 304 is released from the lock position. In this way, it takes the same time for the contact to close at each switching on operation independent of variations of the operators' operations. The unlock point 404 of the lock component 304 is designed with a convex surface towards the spring 302. The lock point 402 of the lock component 304 is designed with a concave surface facing the crossbar 308. For example, the lock component 304 may have a bump on the surface that contacts the spring 302. When the lock component 304 is pushed out of the locking position, the spring portion 320 is compressed and the lever portion 322 contacts the side wall of the crossbar 308. The lock component is engaged with the lock receiving section for a period of time. The period of time is determined according to the distance between the lock point 402 and the unlock point 404.

The subject matter as described above includes various exemplary aspects. However, it should be appreciated that it is not possible to describe every conceivable component or methodology for purposes of describing these aspects. One of ordinary skill in the art can recognize that further combinations or permutations can be possible. Various methodologies or architectures can be employed to implement the various embodiments, modifications, variations, or equivalents thereof. Accordingly, all such implementations of the aspects described herein are intended to embrace the scope and spirit of subject claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A switch device for opening and closing electric contacts, comprising:

a lock component comprising a spring portion and a lever portion; and a crossbar defining a lock receiving section for engaging with the lever portion, wherein the lever portion is pushed by the spring portion to be engaged with the lock receiving section and hold the crossbar in a lock position when the switch device is in an OFF operational mode, wherein when the switch device is switched to an ON operational mode, the crossbar is initially in the lock position until the lever portion is moved to disengage from the lock receiving section and release the crossbar from the lock position to enable movement of the crossbar;

wherein the lever portion is pushed away from the lock receiving section by a spring reaching and contacting an unlock point of the lever portion.

2. The switch device of claim 1, wherein the unlock point is formed on an opposite side of the lock component relative to where the spring portion is arranged.

3. A circuit breaker comprising the switch device of claim 1.

4. The switch device of claim 1, wherein the lock component is a unitary component formed of one material.

5. The switch device of claim 1, wherein the lever portion and the spring portion are separated pieces.

6. The switch device of claim 5, wherein the lever portion is made of plastic and the spring portion is made of metal, wherein the lever portion and the spring portion are connected.

7. The switch device of claim 5, wherein the lever portion and the spring portion are formed of different materials.

8. A switch device for opening and closing electric contacts, comprising:

a lock component comprising a spring portion and a lever portion;

a crossbar defining a lock receiving section for receiving the lever portion of the lock component, a lever connected between the crossbar and an operating element, and a spring connected to the lever, wherein when the switch device is in an OFF operational mode via the operating element being in a first operating element position, the spring is configured to move the lever which moves the crossbar into a lock position in which the lock receiving section is able to receive the lever portion of the lock component, and the spring portion of the lock component is configured to force the lever portion of the lock component into the lock receiving section to hold the crossbar in the lock position and prevent movement of the crossbar, wherein when the switch device is in an ON operational mode via movement of the operating element from the first operating element position to a second operating element position, the lever is moved via the movement of the operating element thereby causing the spring to contact an unlock point on the lever portion of the lock component, the spring is configured to push the lever portion of the lock component out of the lock receiving section and compress the spring portion of the lock component, and the crossbar is released from the locked position to enable movement of the crossbar.

9. The switch device of claim 8, wherein the spring is connected to a middle portion of the lever, wherein the spring is at rest when the middle portion of the lever reaches an end position that corresponds to the locked position of the crossbar.

10. The switch device of claim 8, wherein the lever portion is configured to be engaged with the lock receiving section for a period of time that corresponds to a distance between an end of the lever portion that engages the lock receiving section and the unlock point of the lever portion.

11. A circuit breaker; comprising the switch device according to claim 8.

12. The switch device of claim 8, wherein one end of the spring portion of the lock component is fixed to a latch plate of the switch device and another end is connected to the lever portion.

13. The switch device of claim 8 further comprising a lock plate, wherein the crossbar is configured to move away from the lock plate when moving toward the lock position and toward the lock plate after the crossbar is released from the locked position.

14. The switch device of claim 8, wherein the lever portion is configured to slide along a side wall of the crossbar when the crossbar is released from the lock position.

15. The switch device of claim 8, wherein the lock component is a singled piece component that comprises the lever portion, a fixed portion, and the spring portion.

16. The switch device of claim 15, wherein the fixed portion is connected to a latching plate of the switch device.

17. The switch device of claim 8, wherein the lock component, the lever, and the spring are mounted on a lock plate.

18. The switch device of claim 17, wherein the spring has an end that is fixed to the lock plate.

* * * * *